United States Patent [19]

Cassidy, Sr. et al.

[11] 4,341,097

[45] Jul. 27, 1982

[54] HOSIERY ARTICLE WITH A REINFORCED TOE WITH VARYING DENSITY

[75] Inventors: Edward L. Cassidy, Sr.; William B. Cothran, both of Burlington; Sam C. Safrit, Pfafftown, all of N.C.

[73] Assignee: Kayser-Roth Hosiery, Inc., Burlington, N.C.

[21] Appl. No.: 170,698

[22] Filed: Jul. 21, 1980

[51] Int. Cl.[3] ..... A41B 11/02

[52] U.S. Cl. ..... 66/187; 66/185

[58] Field of Search ..... 66/178, 178 A, 182, 66/184, 185, 186, 187

[56] References Cited

U.S. PATENT DOCUMENTS

| | | | |
|---|---|---|---|
| 2,081,186 | 5/1937 | Schletter | 66/182 |
| 2,092,616 | 9/1937 | Ruckel | 66/185 |
| 2,102,368 | 12/1937 | Martel | 66/185 X |
| 2,229,790 | 1/1941 | Beuter et al. | 66/182 |
| 4,186,471 | 2/1980 | Wehrmann et al. | 66/187 |

*Primary Examiner*—Ronald Feldbaum

*Attorney, Agent, or Firm*—Bell, Seltzer, Park & Gibson

[57] ABSTRACT

A reinforced toe with varying density is provided for hosiery articles such as sheer stockings, pantyhose and the like so that there is no sharply contrasting line of demarcation between the sheer fabric in the foot portion and the reinforced fabric in the toe pocket and while providing full reinforcement in the area of the toe pocket at the ends of the toes where the need is greatest. The reinforced toe is produced by knitting a reinforcing yarn in plated relationship with the body yarn in spaced-apart courses in a first group of courses adjacent the sheer foot and knitting the reinforcing yarn in more closely spaced courses of a second group of courses adjacent the closed end of the toe pocket. This arrangement provides a gradual or stepped transition from the sheer fabric of the foot to the relatively heavy fabric at the closed end of the toe pocket and provides the reinforced toe with varying or increasing fabric density from the foot to the closed end thereof.

6 Claims, 3 Drawing Figures

HOSIERY ARTICLE WITH A REINFORCED TOE WITH VARYING DENSITY

FIELD OF THE INVENTION

This invention relates generally to hosiery articles and more particularly to relatively sheer stockings, pantyhose and the like knit of fine denier yarn and provided with a reinforced toe with varying or increasing density from the foot to the closed end of the toe pocket.

BACKGROUND OF THE INVENTION

In the knitting of ladies' fine denier sheer stockings and the like, it is the usual practice to knit the leg and foot portion of a fine denier yarn and to knit a heavy denier reinforcing yarn in plated relationship with the body yarn throughout the toe pocket. The reinforcing yarn in the toe pocket adds strength and wearability in the area at the ends of the toes where the need is greatest. However, the reinforced toe pocket produces a very definite and sharply contrasting line of demarcation between the fine denier body yarn in the foot portion and the reinforcing and body yarn in the toe pocket and this line of contrasting fabric density is objectionable for wear with open-toed shoes, such as sandals and the like.

In order to provide hosiery articles which are acceptable for wear with open-toed or sandal type shoes, it is the current practice to knit a fine denier yarn throughout the entire foot and toe. This type of hosiery, sometimes referred to as a sandal or nude toe, is considered to be more fashionable when worn with open-toed shoes, however, this type of hosiery article lacks durability because of insufficient reinforcement at the location of greatest wear, the ends of the toes, and usually results in a very short wear life for the hosiery article.

SUMMARY OF THE INVENTION

With the foregoing in mind, it is an object of the present invention to provide a hosiery article with a reinforced toe with varying or increasing density so that there is no sharply contrasting line of demarcation between the sheer fabric in the foot portion and the reinforced fabric in the toe pocket and while providing full reinforcement in the area of the toe pocket at the ends of the toes where the need is greatest.

In accordance with the present invention, a fine denier body yarn is knit to form successive courses extending throughout the foot and toe pocket of the hosiery article. A reinforcing yarn is knit in plated relationship with the body yarn in certain spaced apart courses of a first group of courses adjacent the end of the toe pocket which is knit integrally with the foot. The reinforcing yarn is also knit in plated relationship with the body yarn in certain courses of a second group of courses adjacent the closed end of the toe pocket. The certain courses in the first group of courses are spaced further apart than the certain courses of the second group of courses so that the density of the knit fabric in the first group of courses is slightly greater than the density of the knit fabric in the adjacent foot portion and the density of the knit fabric in the first group of courses is less than the density of the knit fabric in the second group of courses positioned at the closed end of the toe pocket. Thus, the density of the knit fabric of the toe pocket progressively increases from the foot portion to the closed end of the toe pocket and the greatest reinforcement is provided in the location where the need is greatest, in the second group of courses which is positioned at the closed end of the toe pocket. This arrangement provides a gradual or stepped transition from the sheer fabric of the foot to the relatively heavy fabric at the closed end of the toe pocket and surprisingly eliminates the sharply contrasting line of demarcation usually provided when an immediate transition is made from the fine sheer fabric of the foot to the fully reinforced toe.

The reinforced toe with varying or increasing density can be provided in a hosiery article having a conventional type of reciprocatorily knit toe pocket and can also be provided in a hosiery article having a "fishmouth" type toe pocket, as illustrated and described in the present application. In a preferred embodiment the reinforcing yarn is knit in plated relationship with the body yarn in every fourth course of the first group of courses adjacent the end of the toe pocket integrally knit with the foot portion and the reinforcing yarn knit in plated relationship with the body yarn in every other course of the second group of courses positioned adjacent the closed end of the toe pocket. The sheer foot portion of the stocking is usually knit of a fine denier yarn, within the range of about 10 to 20 denier and it is preferred that the reinforcing yarn also be of a relatively fine denier, within the range of about 10 to 15 denier.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
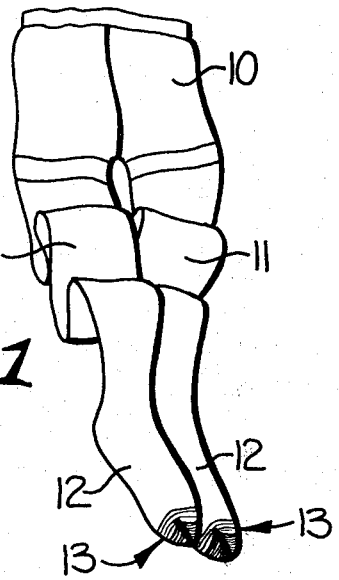
FIG. 1 is a perspective view of a hosiery article in the form of a pair of pantyhose with reinforced toe pockets of increasing density formed thereon.

The hosiery article with reinforced toes with varying or increasing density is illustrated in FIG. 1 in the form of a pantyhose including an upper panty portion 10 and integrally knit legs 11, feet 12, and toe pockets, broadly indicated at 13. The legs 11, feet 12 and toe pockets 13 are knit of a relatively fine denier body yarn, indicated at Y in FIG, 3, and form successive courses (C-1 through C-21) of stitch loops. The foot 12 is knit exclusively of the fine denier body yarn Y to provide a sheer fabric in the foot which extends to the rear end of the toe pocket 13.

Figure 2:
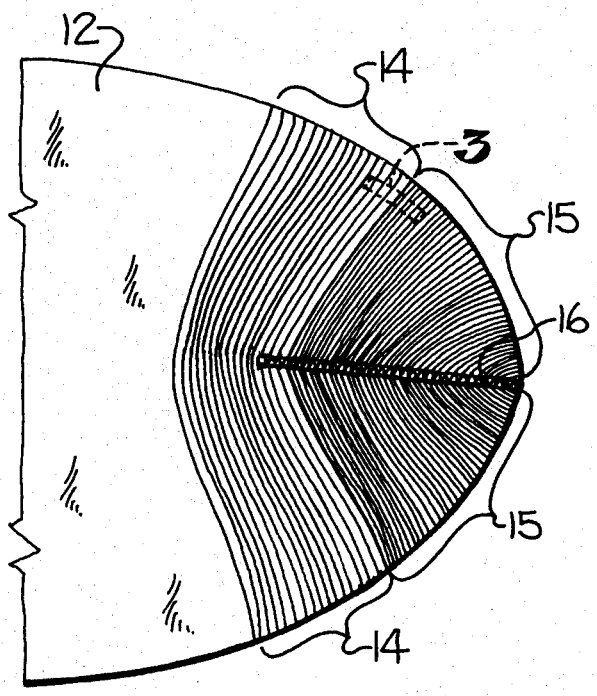
FIG. 2 is a greatly enlarged elevational view of one side of a portion of the foot portion and illustrating the reinforced toe of increasing density incorporated in a "fishmouth" type toe pocket.
Figure 3:
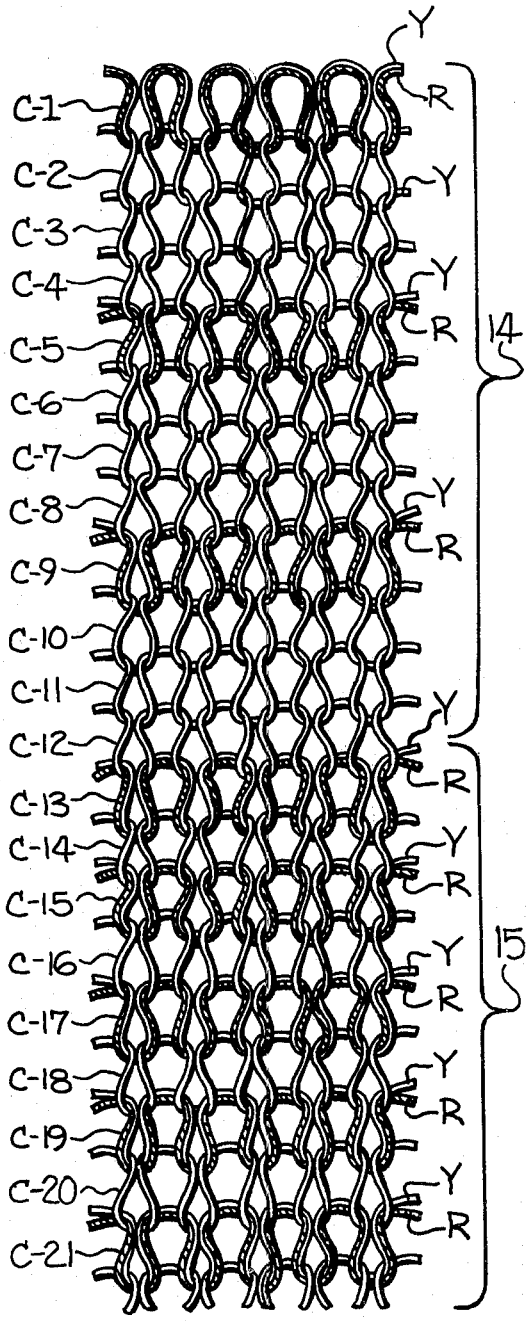
FIG. 3 is a greatly enlarged elevational view of the knit fabric in the area of the dash-dot rectangle 3 in FIG. 2 and illustrating the manner in which the reinforcing yarn is knit in plated relationship with certain of the body yarn courses in the respective first and second groups of courses in the toe pocket.

A reinforcing yarn, indicated at R in FIG. 3, is knit in plated relationship with the body yarn Y in certain courses of a first group of courses, indicated at 14 in FIG. 2, positioned adjacent and knit integral with the end portion of the toe pocket 13 adjacent the foot 12. The reinforcing yarn R is also knit in plated relationship with the body yarn Y is certain courses of a second group of courses, indicated at 15 in FIG. 2, positioned adjacent the forward or closed end of the toe pocket 13.

As illustrated in FIG. 3, the reinforcing yarn R is knit in plated relationship with the body yarn Y in every fourth course (courses C-1, C-5 and C-9) in the first group of courses 14. The reinforcing yarn R is knit in plated relationship with the body yarn Y in every other course (courses C-13, C-15, C-17, C-19, and C-21 in FIG. 3) in the second group of courses 15. Thus, the certain courses of the first group of courses 14 are spaced further apart than the certain courses of the second group of courses 15 so that the density of the knit fabric in the first group of courses is less than the density of the knit fabric in the second group of courses 15. Also, the density of the knit fabric in the first group of courses 14 is slightly greater than the density of the knit fabric in the adjacent foot portion 12.

Thus, the density of the knit fabric of the toe pocket increases from the foot portion 12 to the closed end of the toe pocket 13. This arrangement provides the greatest reinforcement in the location where the need is greatest, in the second group of courses 15 which is positioned at the closed end of the toe pocket 13. Also, the gradual or stepped transition from the sheer fabric of the foot 12 to the relatively heavy reinforced fabric at the closed end of the toe pocket 13 eliminates the sharply contrasting line of demarcation usually provided when an immediate transition is made from the sheer fabric of the foot to the fully reinforced toe.

The reinforced toe with varying or increasing density can be provided in a hosiery article having a conventional type of reciprocatorily knit toe pocket. In the present instance, the toe with varying or increasing density is illustrated as being provided in a hosiery article having a "fishmouth" type toe pocket 13. As is well known, this "fishmouth" type toe closure includes a closure seam 16 extending around the closed end of the toe pocket 13 and having terminal ends at opposite sides of the toe pocket. As will be noted in FIG. 2, the second group of courses 15 extends from the closed end of the toe pocket to a position intermediate the ends of the closure seam 16 and the first group of courses 14 extends from the second group of courses 15 and beyond the terminal ends of the closure seam 16.

As a specific but nonlimiting example, it has been found that a satisfactory reinforced toe pocket 13 can be formed by knitting the foot portion 12 of a body yarn Y of 14/7 denier stretch nylon and knitting a reinforcing yarn R of 10/7 denier stretch nylon in plated relationship with the body yarn in every fourth course in the first group of courses 14. The reinforcing yarn R is then knit in plated relationship with the body yarn Y in every other course of the second group of courses 15.

However, it is to be understood that the reinforcing yarn R can be knit in other relationships in plated relationship with certain courses of the body yarn Y in the first and second groups of courses 14, 15. For example, the reinforcing yarn R could be knit in plated relationship with the body yarn Y in every other course of the first group of courses 14 and then knit in plated relationship with the body yarn Y in every course of the second group of courses 15. Also, the reinforcing yarn R could be knit in plated relationship with certain courses of the body yarn Y in more than two groups of courses. For example, the reinforcing yarn R could be knit in plated relationship with the body yarn Y in every fourth course in a first group of courses, knit in plated relationship in every other course in a second group of courses and knit in plated relationship in every course in a third group of courses.

In the drawings and specifications there has been set forth the best mode presently comtemplated for the practice of the present invention, and although specific terms are employed, they are used in a generic and descriptive sense only and not for purposes of limitation, the scope of the invention being defined in the claims.

That which is claimed is:

1. A hosiery article with a reinforced toe of increasing density including a foot with a toe pocket, said toe pocket being integrally knit with said foot at one end and being closed at the other end thereof, said foot and toe pocket being knit of a body yarn and forming successive courses extending throughout said foot and toe pocket, and a reinforcing yarn knit in plated relationship with said body yarn in every fourth course of a first group of courses adjacent said one end of said toe pocket, said reinforcing yarn being knit in plated relationship with said body yarn in every other course of a second group of courses adjacent said closed end of said toe pocket, the density of the knit fabric in said first group of courses being greater than the density of the knit fabric in the adjacent foot portion and being less than the density of the knit fabric in said second group of courses so that the density of the knit fabric of said toe pocket increases from the adjacent foot portion to the closed end of said toe pocket.

2. A hosiery article with a reinforced toe of progressively increasing density including a foot with a toe pocket, said toe pocket being integrally knit with said foot at one end and being closed at the other end thereof, said foot and toe pocket being knit of a body yarn and forming successive courses extending throughout said foot and toe pocket, and a reinforcing yarn knit in plated relationship with said body yarn in certain courses of a first group of courses adjacent said one end of said toe pocket, said reinforcing yarn being knit in plated relationship with said body yarn in certain courses of a second group of courses adjacent said closed end of said toe pocket, said certain courses of said first group of courses being spaced further apart than said certain courses of said second group of courses, the density of the knit fabric in said first group of courses being greater than the density of the knit fabric in the adjacent foot portion and being less than the density of the knit fabric in said second group of courses so that the density of the knit fabric of said toe pocket increases from the adjacent foot portion to the closed end of said toe pocket.

3. A hosiery article according to claim 2 wherein said certain courses of said first group of courses comprises every fourth course, and wherein said certain courses of said second group of courses comprises every other course.

4. A hosiery article according to claims 2 or 3 wherein said toe pocket is of a "fishmouth" type and includes a closure seam extending around said closed end and including terminal ends at opposite sides of said toe pocket.

5. A hosiery article according to claim 4 wherein said second group of courses extends from said closed end of said toe pocket to a position intermediate the ends of said closure seam, and wherein said first group of courses extends from said second group of courses and beyond said terminal ends of said closure seam.

6. A hosiery article according to claim 2 wherein said body yarn is of a relatively fine denier, within the range of about 10 to 20 denier, so that the knit fabric of said foot portion is relatively sheer, and wherein said reinforcing yarn is also of a relatively fine denier, within the range of about 10 to 15 denier.

* * * * *